US007219798B2

(12) United States Patent
Chen

(10) Patent No.: US 7,219,798 B2
(45) Date of Patent: May 22, 2007

(54) ANTISTATIC TRANSPORT PACKAGE FOR LCD CELLS

(75) Inventor: Ping-Shen Chen, Chubel (TW)

(73) Assignee: Hannstar Display Corp., Taipei (TW)

( * ) Notice: Subject to any disclaimer, the term of this patent is extended or adjusted under 35 U.S.C. 154(b) by 468 days.

(21) Appl. No.: 10/757,538

(22) Filed: Jan. 15, 2004

(65) Prior Publication Data

US 2005/0155904 A1 Jul. 21, 2005

(51) Int. Cl.
*B65D 85/48* (2006.01)

(52) U.S. Cl. ..... 206/454; 206/593

(58) Field of Classification Search ..... 206/706, 206/709, 710, 718, 719, 721, 454, 453, 523, 206/593, 594, 320
See application file for complete search history.

(56) References Cited

U.S. PATENT DOCUMENTS

| | | | | | |
|---|---|---|---|---|---|
| 3,615,006 | A * | 10/1971 | Freed | ..... | 206/454 |
| 4,892,193 | A * | 1/1990 | Thomas | ..... | 206/453 |
| 5,320,225 | A * | 6/1994 | Kirkpatrick | ..... | 206/449 |
| 6,286,684 | B1 * | 9/2001 | Brooks et al. | ..... | 206/710 |
| 6,662,950 | B1 * | 12/2003 | Cleaver | ..... | 206/710 |

* cited by examiner

*Primary Examiner*—Shian T. Luong
(74) *Attorney, Agent, or Firm*—Rabin & Berdo, PC

(57) ABSTRACT

An antistatic transport package for LCD cells. A case includes a body and a cover with cushioning members mounted on the inner surfaces thereof. Protective film surrounds the LCD cells in the case. The antistatic transport package also uses replaceable film in the body, enclosing the protective film and the LCD cells, preventing contamination.

16 Claims, 4 Drawing Sheets

ANTISTATIC TRANSPORT PACKAGE FOR LCD CELLS

BACKGROUND OF THE INVENTION

1. Field of the Invention

The present invention relates to a transport package, and in particular to an antistatic transport package for LCD cells.

2. Description of the Related Art

Currently, liquid crystal display (LCD) cells comprise partially completed LCD panels, or glass substrates enclosing liquid crystal molecules therebetween without surface mounting control chips or assembly frame of conventional LCD panels. After fabrication, LCD cells have to be packed in boxes for transport to subsequent assembly facilities by air, land, or sea transports for following fabricating steps.

In FIG. 1, the conventional package 10 for LCD cells 1 comprises inner and outer boxes 12, 16. The inner box 12 has a plurality of spacers 124 with equal intervals 122 to position the LCD cells 1. After LCD cells 1 are vertically placed into the inner box 12 and the cover 14 is closed, the inner box 12 is placed into the outer box 16 and the cover 18 closes. Because the inner box is made of resilient polystyrene plastic and the outer box of polypropylene, LCD cells therein are protected from contaminants, electrostatic charges and damage from impact during transport. However, the profile of the conventional transport package is large and occupies much space during transport, complicating storage and transport and increasing costs. There is, thus, a need for a compact and reliable transport package for LCD cells.

SUMMARY OF THE INVENTION

Accordingly, an object of the invention is to provide a transport package for LCD cells with smaller profile to ease storage and transport thereof.

Another object of the invention is to provide an antistatic transport package for LCD cells, protecting the LCD cells from electrostatic discharge-related damage.

A third object of the invention is to provide a transport package for LCD cells which can be unpacked easily.

A fourth object of the invention is to provide a transport packaging method, protecting partially completed LCD cell from physical damage during packing.

The present invention provides an antistatic transport package for LCD cells. The antistatic transport package comprises a body, cover and plurality of cushioning members mounted on the inner surfaces thereof. Protective films are disposed on top or bottom of each of the LCD cells in the case.

In a preferred embodiment, the antistatic transport package further comprises replaceable film disposed in the body, enclosing the protective film and the LCD cells, preventing contamination.

The body and the cover are integrally formed, connected by a folded edge. The cover has a plurality of lug portions with hook and loop fastening tapes disposed thereon, and can be fixed to the body when closed. The case comprises antistatic polypropylene (PP) corrugated board. The cushioning members are high density polyethylene (HDPE) foam sheets. The protective film is low density polyethylene (LHPE) foam. The replaceable film comprises polyethylene The present invention also provides a method for transport packaging of LCD cells. First, a case with a plurality of cushioning members mounted on inner surfaces thereof is provided. Next, protective films envelops the LCD cells which are then placed into the case.

In a preferred embodiment, replaceable film is placed into the case, enclosing the protective film covered the LCD cells.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings which are given by way of illustration only, and thus are not limitation of the present invention, and wherein.

DETAILED DESCRIPTION OF THE INVENTION

Figure 1:
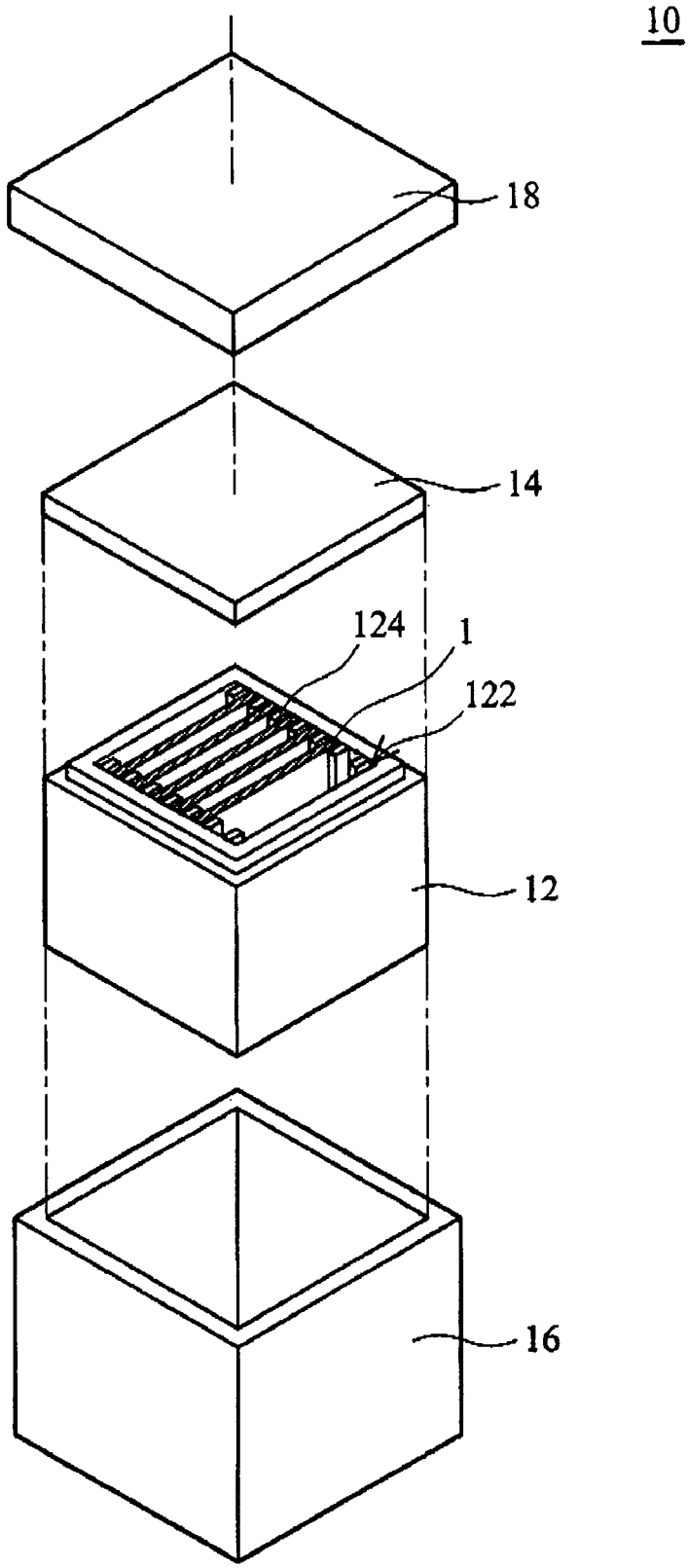
FIG. 1 ( RELATED ART )
FIG. 1 is an exploded perspective view of a conventional transport package for LCD-cells.
Figure 2A:
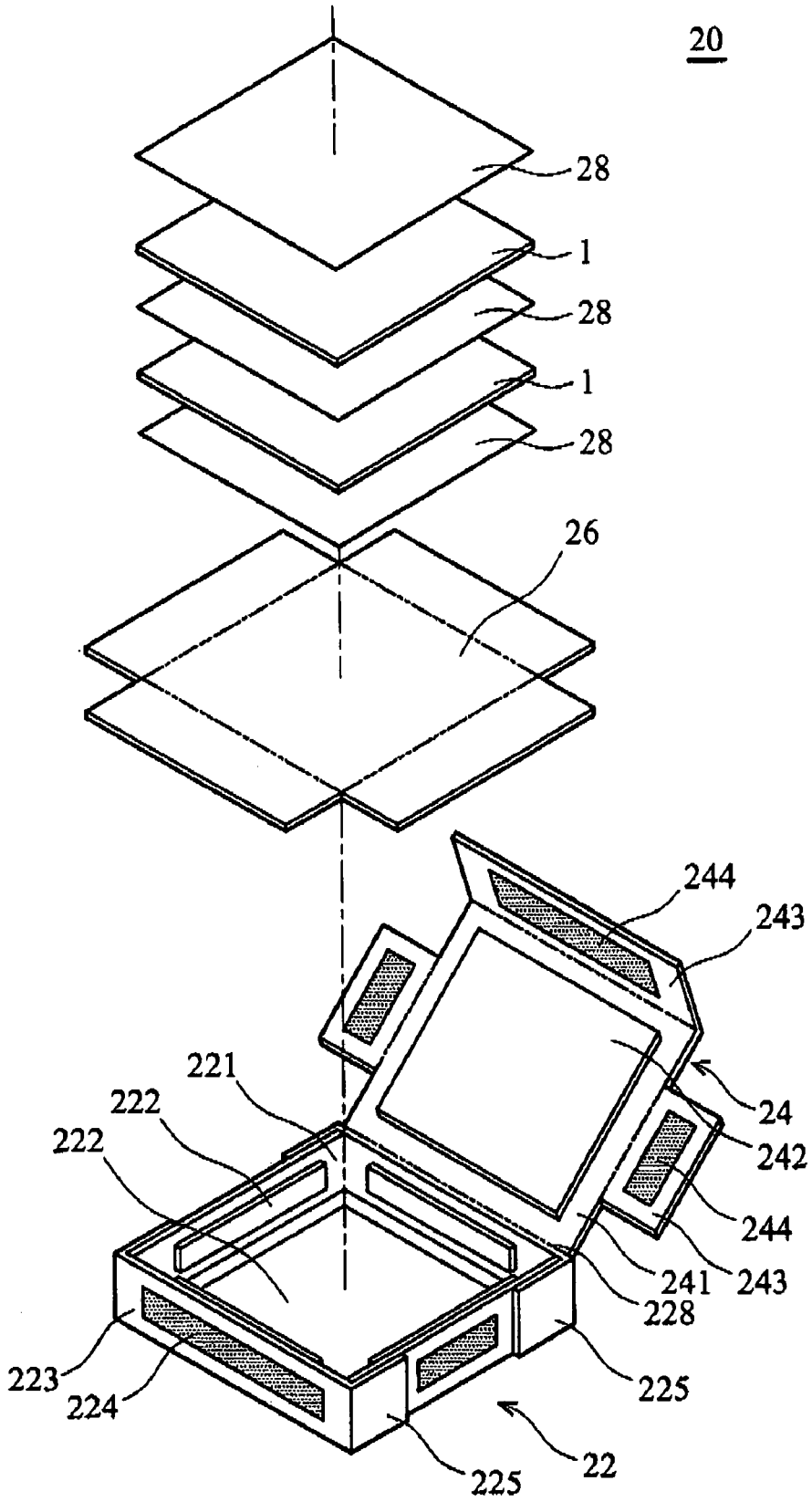
FIG. 2A is an exploded perspective view of the antistatic transport package for LCD cells of the invention.
Figure 2B:
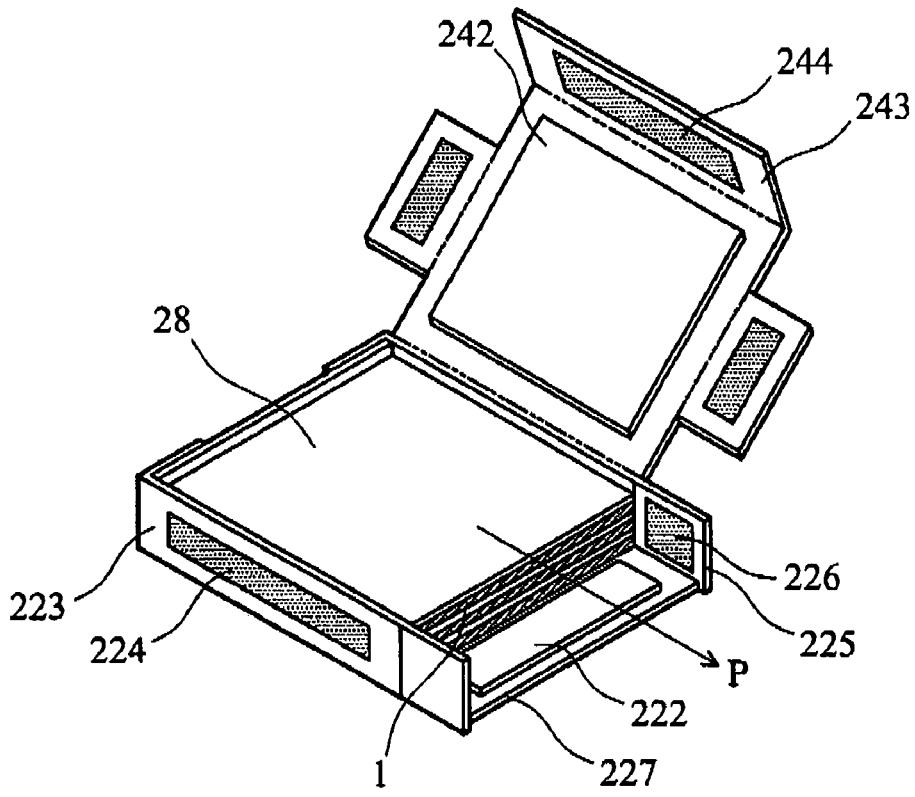
FIG. 2B is a perspective view of the antistatic transport package in FIG. 2A after unpacking.

FIG. 2A shows an antistatic transport package for LCD cells of the invention. In FIG. 2A, the antistatic transport package comprises a case 20, a plurality of cushioning members 222, 242 and protective films 28. The case 20 is integrally formed by folded antistatic corrugated board comprising a body 22 and cover 24 connected by a folded edge 228. The body 22 and cover 24 comprise lug portions 225, 243 bearing rivets (not shown) or hook and loop fastening tapes 226 (FIG. 2B). Outer surfaces 223 of body 22 also bear hook and loop fastening tapes 244, 224 to fix the cover 24, defining a space for LCD cells 1. The cushioning members 222, 242, comprising foam sheets, are mounted on the inner surfaces 221, 241 of the case 20, protecting LCD cells 1 therein from impact damage. Protective film 28 envelops the LCD cells 1 and may be placed into the body 22, such that LCD cells 1 can be packed in the case 20 with a smaller profile.

Replaceable film 26 is placed into the body 22 first, and then protective film 28 and LCD cells 1 are alternatively placed thereon. The replaceable film 26 encloses the protective film 28 and LCD cells 1 to prevent contamination.

In an preferred embodiment, the antistatic corrugated board of the case 20 comprises polypropylene. The cushioning members 222, 242 comprise antistatic high density polyethylene foam. Protective film 28 comprises antistatic low density polyethylene foam. Replaceable film 26 comprises antistatic polyethylene film. The hook and loop fastening tapes 224, 244, 226 comprise Nylon or polypropylene.

FIG. 2B shows the antistatic transport package in FIG. 2A after unpacking in an assembly facility. In FIG. 2B, the case 20 is unpacked, and the right sidewall 227 can be separated easily by way of the hook and loop fastening tapes 226 on the lug portions 225, allowing convenient removal of protective films 28 and LCD cells 1 in direction P for subsequent process.

Figure 3:
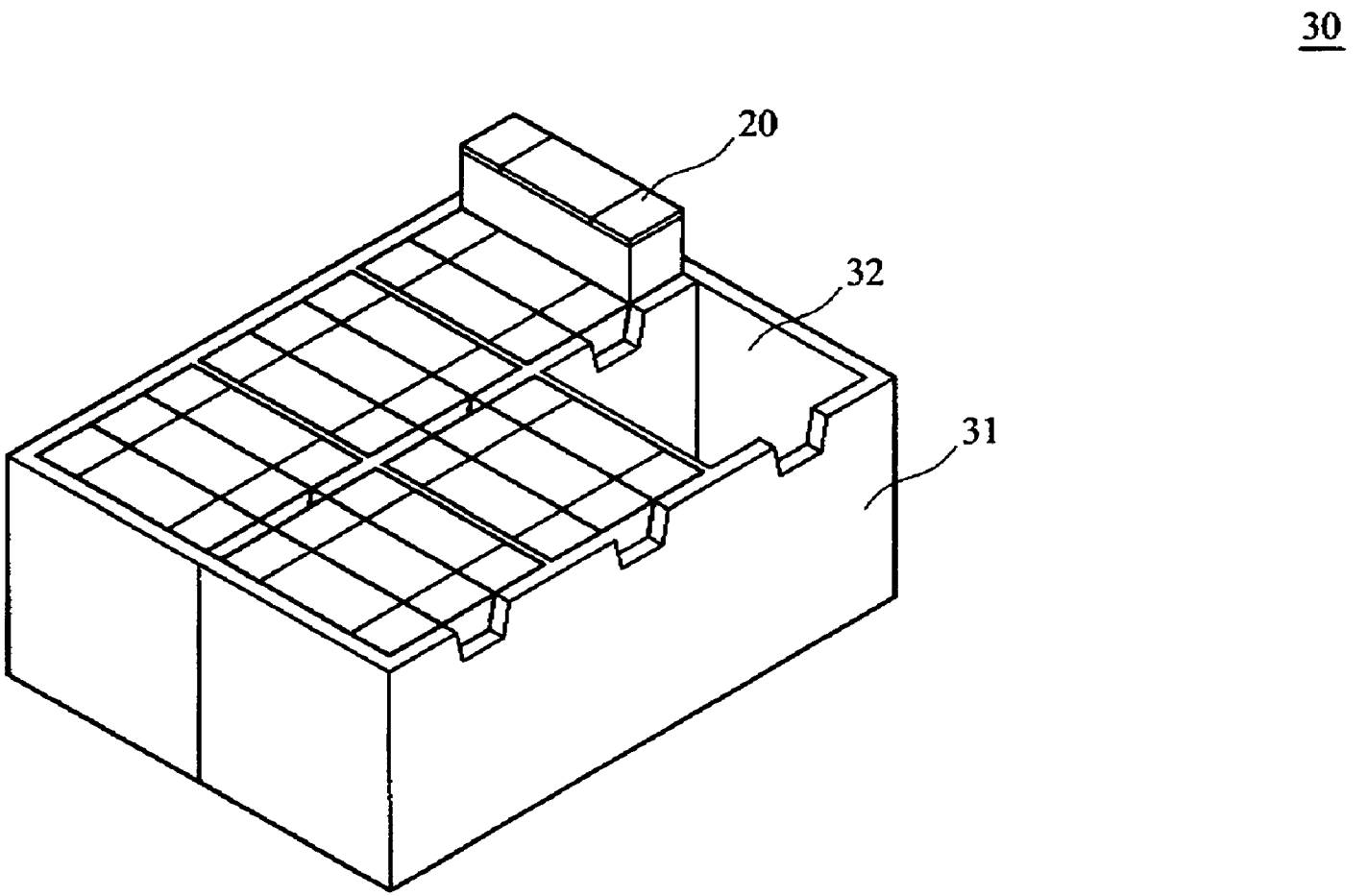
FIG. 3 is a perspective view of multiple transport packages of the invention deployed for transport.

FIG. 3 shows multiple transport packages of the invention deployed for transport. For convenience of transport, the antistatic packages 20 are sequentially placed into cavities 32 of a frame 31 of conductive corrugated boards, which ground electrostatic charges and strengthen the entire assembly.

Accordingly, the antistatic transport package protects partially completed LCD cells from electrostatic charges and impact damage a smaller profile, easing storage requirements and presents reducing transport costs. Furthermore, the antistatic transport package can be easily unpacked.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antistatic transport package for LCD cells, comprising:

a case comprising a body and a cover with a plurality of inner surfaces, the cover comprising a plurality of lug portions with hook and loop fastening tapes disposed thereon;

a plurality of cushioning members mounted on the inner surfaces of the body and the cover; and a plurality of protective films disposed in the case, each protective film being positionable either over or under a respective LCD cell.

2. The antistatic transport package as claimed in claim 1, wherein the body and the cover are integrally formed, connected by a folded edge.

3. The antistatic transport package as claimed in claim 1, wherein the body comprises a plurality of lug portions with hook and loop fastening tapes disposed thereon, the cover being fixed to the body by the hook and loop fastening tapes on the lug portions of the cover and the body when closed.

4. An antistatic transport package for LCD cells, comprising:

a case comprising a body and a cover with a plurality of inner surfaces;

a plurality of cushioning members mounted on the inner surfaces of the body and the cover; and a plurality of protective films disposed in the case, each protective film being positionable either over or under a respective LCD cell; and a replaceable film disposed in the body, and being adapted to enclose the protective film and the LCD cells.

5. The antistatic transport package as claimed in claim 1, wherein the case comprises a folded antistatic polypropylene corrugated board.

6. The antistatic transport package as claimed in claim 1, wherein the cushioning members comprise polyethylene foam.

7. The antistatic transport package as claimed in claim 1, wherein the protective film comprises polyethylene foam.

8. The antistatic transport package as claimed in claim 4, wherein the replaceable film comprises polyethylene.

9. The antistatic transport package as claimed in claim 4, wherein the case comprises a folded antistatic polypropylene corrugated board.

10. The antistatic transport package as claimed in claim 4, wherein the cushioning members comprise polyethylene foam.

11. The antistatic transport package as claimed in claim 4, wherein the protective film comprises polyethylene foam.

12. A multi-unit transport package for LCD cells, comprising:

a plurality of antistatic transport packages, each package comprising:

a case comprising a body and a cover with a plurality of inner surfaces, the cover comprising a plurality of lug portions with hook and loop fastening tapes disposed thereon;

a plurality of cushioning members mounted on the inner surfaces of the body and the cover; and a plurality of protective films disposed in the case, each protective film being positionable either over or under a respective LCD cell; and a frame with a plurality of cavities to house the antistatic transport packages.

13. The antistatic transport package as claimed in claim 12, wherein the frame comprises conductive polypropylene corrugated boards.

14. The antistatic transport package as claimed in claim 12, wherein the case comprises a folded antistatic polypropylene corrugated board.

15. The antistatic transport package as claimed in claim 12, wherein the cushioning members comprise polyethylene foam.

16. The antistatic transport package as claimed in claim 12, wherein the protective film comprises polyethylene foam.

* * * * *